US005904276A

United States Patent [19]

Chen et al.

[11] Patent Number: 5,904,276

[45] Date of Patent: May 18, 1999

[54] EXPANDABLE CLOTHES HANGER BASE

[75] Inventors: Michael Chen, Taipei; Chen Shou Mao, Taichung Hsien, both of Taiwan

[73] Assignee: Chen Shou Mao, Taichung Hsien, Taiwan

[21] Appl. No.: 08/907,987

[22] Filed: Aug. 11, 1997

[51] Int. Cl.[6] ..... A41H 43/00; A47H 1/00; B65D 85/18

[52] U.S. Cl. ..... 223/1; 211/105; 211/104

[58] Field of Search ..... 211/105, 104, 211/85, 38, 195, 200; 206/284, 285, 288, 289; 223/1, 120, DIG. 4

[56] References Cited

U.S. PATENT DOCUMENTS

| | | | |
|---|---|---|---|
| 1,272,819 | 7/1918 | Linnett | 211/105 |
| 1,627,559 | 5/1927 | Haul | 211/105 |
| 2,255,461 | 9/1941 | Williams | 248/277 |
| 2,367,253 | 1/1945 | Williams | 211/105 |
| 3,337,060 | 8/1967 | Artweger | 211/105 |
| 3,801,174 | 4/1974 | Kararr | 312/136 |
| 4,497,413 | 2/1985 | Tolli | 211/202 |

*Primary Examiner*—Bibhu Mohanty
*Attorney, Agent, or Firm*—Harrison & Egbert

[57] ABSTRACT

An expandable clothes hanger base is located in a luggage body and is composed of a plurality of front inclined fork rods and rear inclined fork rods linked with the front inclined fork rods. The front inclined fork rods are provided with a slide clamp slot, a hanging hook and a pivoting slide pillar and are also linked with two rear inclined connection rods and an action body. The action body is provided with a clamp slot, a pivoting slide pillar and a front inclined connection rod. The front inclined fork rods, the rear inclined fork rods, the rear inclined connection rod and the front inclined connection rod are provided respectively with a center pivoting hole, a center pivoting pillar, an end pivoting hole, and a back pivoting hole for engaging the pivoting bolt so as to enable the expandable clothes hanger base to be extracted and retracted. The action body is capable of actuating the front inclined fork rods to join together or move apart.

4 Claims, 9 Drawing Sheets

EXPANDABLE CLOTHES HANGER BASE

FIELD OF THE INVENTION

The present invention relates generally to a clothes hanger base, and more particularly to an expandable clothes hanger base.

BACKGROUND OF THE INVENTION

As shown in FIGS. 1 and 2, a suit hanger base 10 of the prior art comprises a fastening seat 12 having two fastening holes 11, and a hanging frame 13 extending downwards from one end of the fastening seat 12 such that the underside of the fastening seat 12 is parallel to the top of the hanging frame 13 and that the underside of the fastening seat 12 and the top of the hanging frame 13 are provided therebetween with a channel 14. The hanging frame 13 is provided in the top side thereof with a plurality of locating grooves 15. The hanging frame 13 is further provided at the free end thereof with a retaining plate 16. The retaining plate 16 forms an insertion recessed edge 18 along with a retaining projection 17 of the fastening seat 12.

Such a prior art suit hanger base 10 as described is defective in design in that the hangers can not be located in the locating grooves 15, and in that the hangers are prone to slide back and forth in the channel 14 at such time when the luggage is shipped from one place to another. In addition, the suit hangers located in the locating grooves 15 of the hanging frame 13 can not be removed at random. In other words, the suit hangers must be removed from the locating grooves 15 one after another sequentially. Moreover, the suit hangers can not be easily removed from the locating grooves 15 of the hanging frame 13 if the locating grooves 15 are overcrowded.

SUMMARY OF THE INVENTION

The primary objective of the present invention is to provide an expandable clothes hanger base comprising a plurality of front inclined fork rods each having a fork slide clamp slot, a hanging hook and a pivoting slide pillar. The expandable clothes hanger base further comprises a plurality of rear inclined fork rods, read inclined connection rods, and an action body having a front inclined connection rods. Such component parts are capable of cooperating with one another such that the clothes hanger base can be retracted and extracted, and that the hangers can be easily located and removed.

The foregoing objective, features, functions, and advantages of the present invention will be more readily understood upon a thoughtful deliberation of the following detailed description of a preferred embodiment of the present invention with reference to the accompanying drawings.

DETAILED DESCRIPTION OF THE EMBODIMENT

Figure 1:
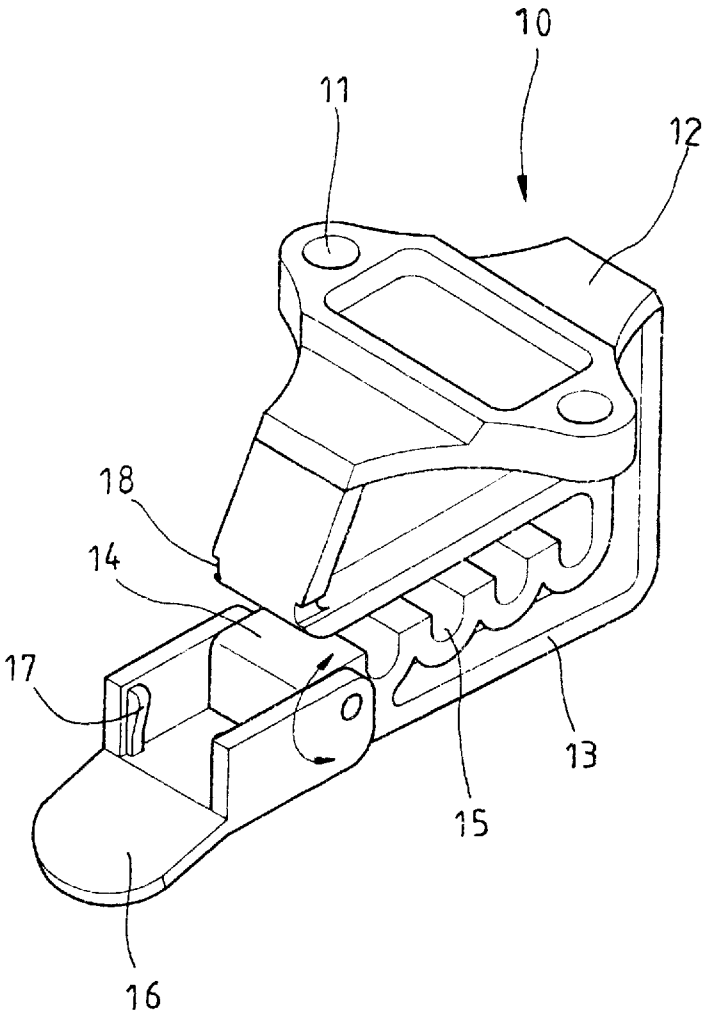
FIG.1 PRIOR ART
FIG. 1 shows a perspective view of a suit hanger base of the prior art.
Figure 2:
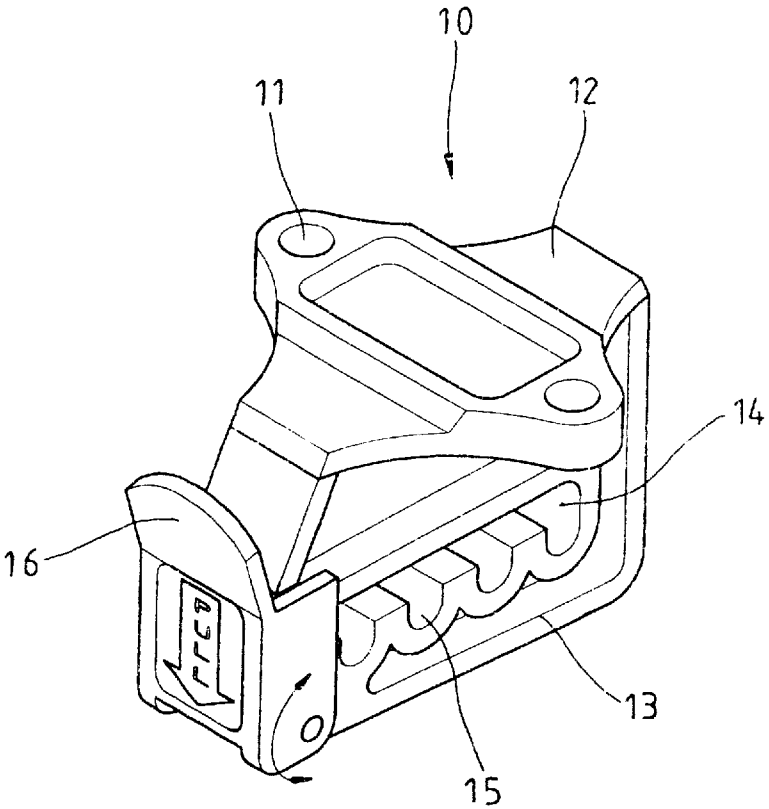
FIG.2 PRIOR ART
FIG. 2 shows another perspective view of the prior art suit hanger base as shown in FIG. 1.
Figure 3:
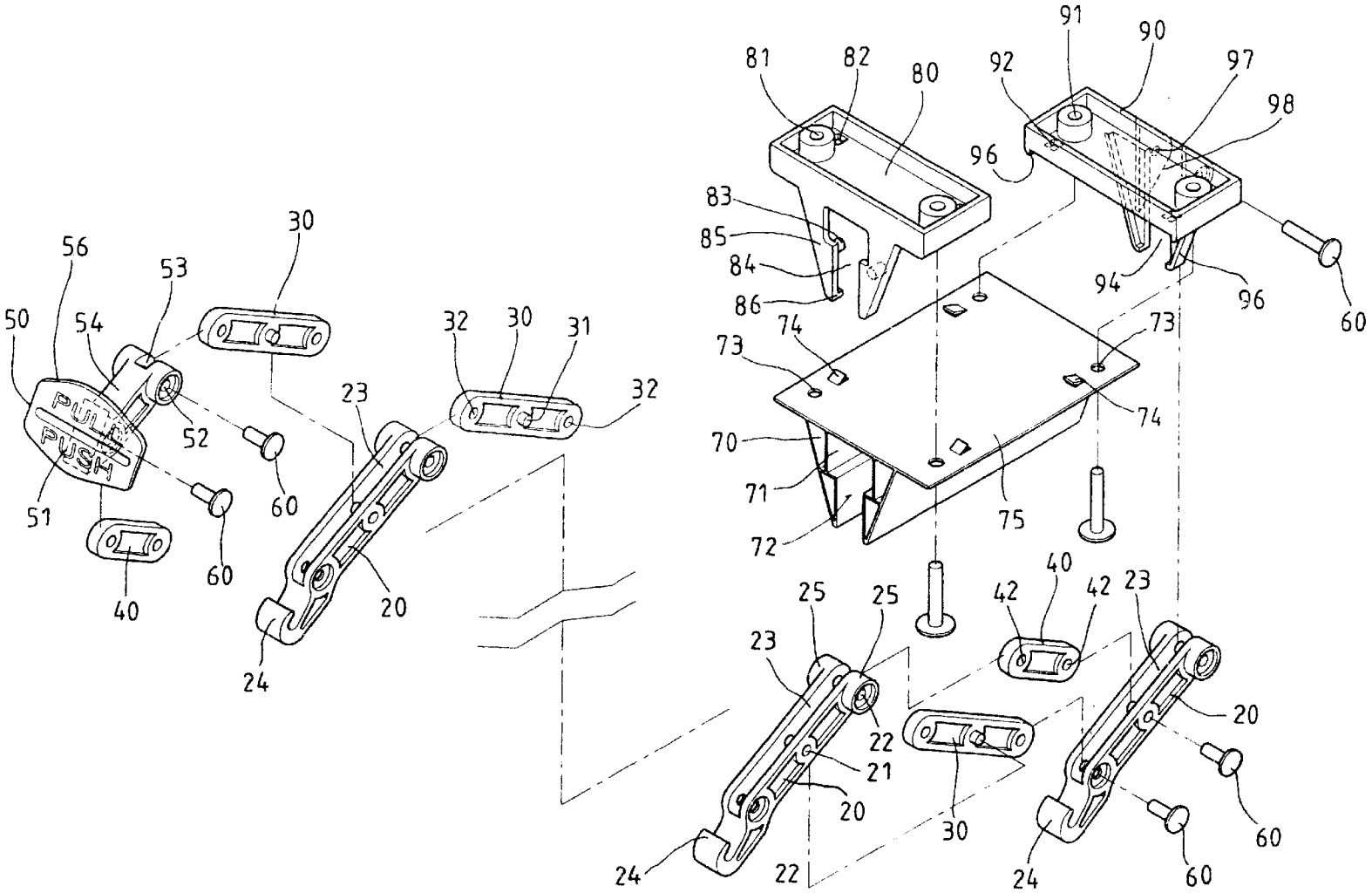
FIG. 3 shows an exploded view of the present invention.
Figure 4:
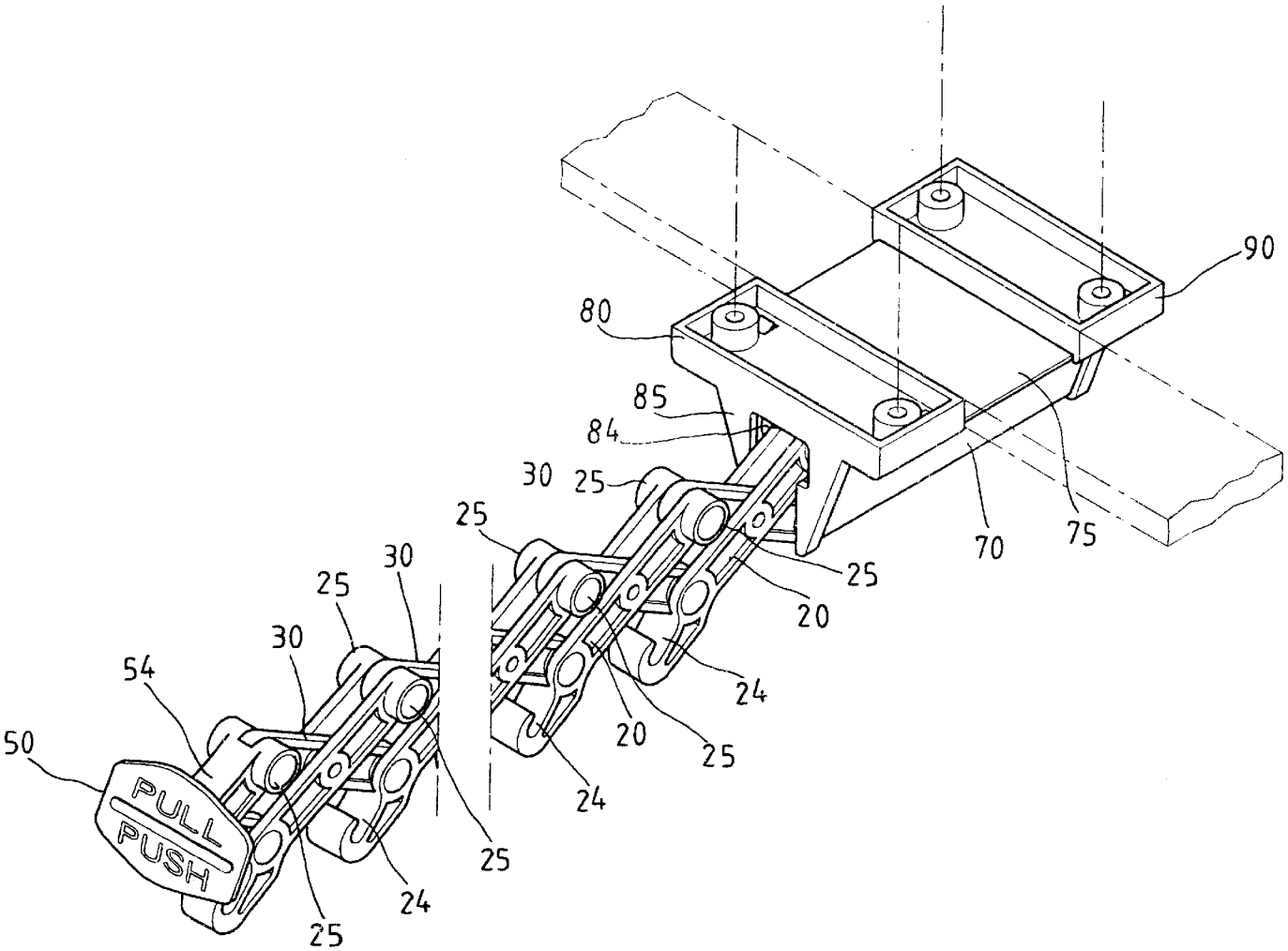
FIG. 4 shows a perspective view of the present invention in combination.

As shown in FIGS. 3 and 4, an expandable clothes hanger base embodied in the present invention is composed of the component parts, which are described explicitly hereinafter.

A plurality of front inclined fork rods 20 are provided horizontally with a center pivoting hole 21 and two end pivoting holes 22. The center line of the thickness is provided with a fork slide clamp slot 23 traversing the pivoting holes 21 and 22. The bottom is provided with a hanging hook 24 which is extended in accordance with the width of the front inclined fork rod 20. The pivoting hole 22 of the front inclined fork rod 20 is provided in the periphery thereof with a pivoting slide pillar 25.

A plurality of rear inclined fork rods 30 are formed such that they have a thickness capable of cooperating with the fork slide clamp slot 23, and that they are provided with a center pivoting pillar 31 and two end pivoting holes 32, which are corresponding to the front inclined fork rods 20.

Two rear inclined connection rods 40 have a thickness capable of cooperating with the fork slide clamp slot 23 and are provided horizontally in the side thereof with two end pivoting holes 42 separated by a distance which is equal to the distance between the center pivoting pillar 31 and the end pivoting hole 32 of the rear inclined fork rod 30.

An action body 50 is provided in the back thereof with a front inclined connection rod 54 having a clamp slot 53. The front inclined connection rod 54 is provided horizontally with a back pivoting hole 51 and an end pivoting hole 52, which are separated from each other by a distance equal to the distance between the center pivoting hole 21 and the end pivoting hole 22 of the front inclined fork rod 20. The periphery of the end pivoting hole 52 of the top end of the front inclined connection rod 54 is provided with a pivoting slide pillar 55.

A plurality of pivoting bolts 60 are used to fasten pivotally the front inclined fork rods 20 with the rear inclined fork rods 30, the rear inclined connection rods 40 with the front inclined fork rods 20, and the front inclined connection rod 54 with the rear inclined connection rods 40 and the rear inclined fork rods 30.

Figure 5:
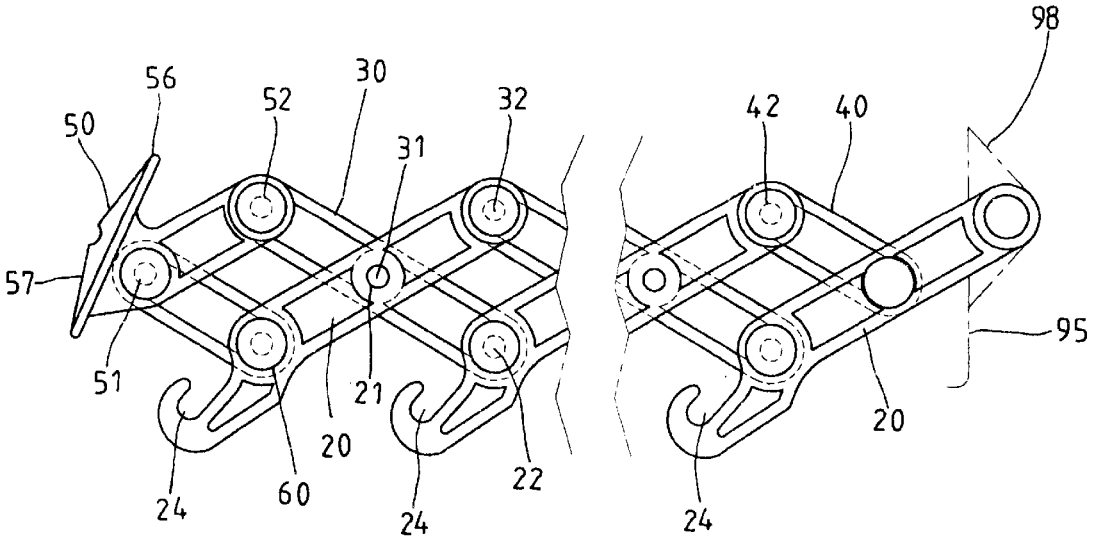
FIG. 5 shows a side schematic view of the present invention in combination.
Figure 8:
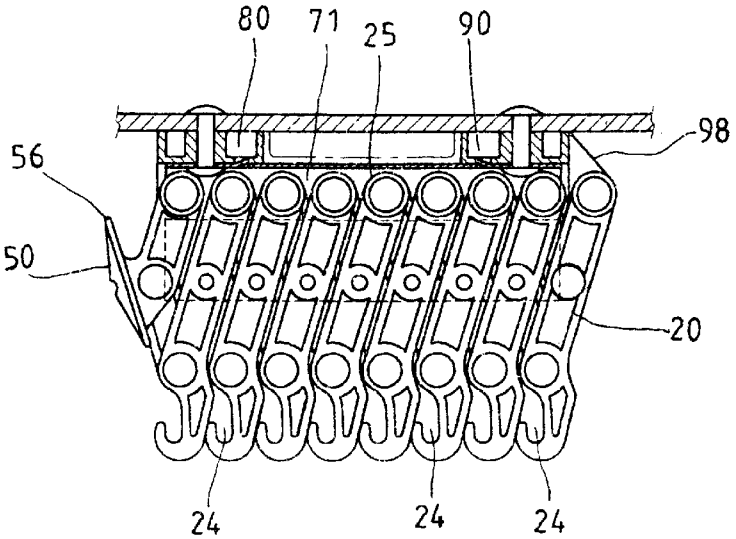
FIG. 8 shows a schematic view of the present invention in the folded state.
Figure 9:
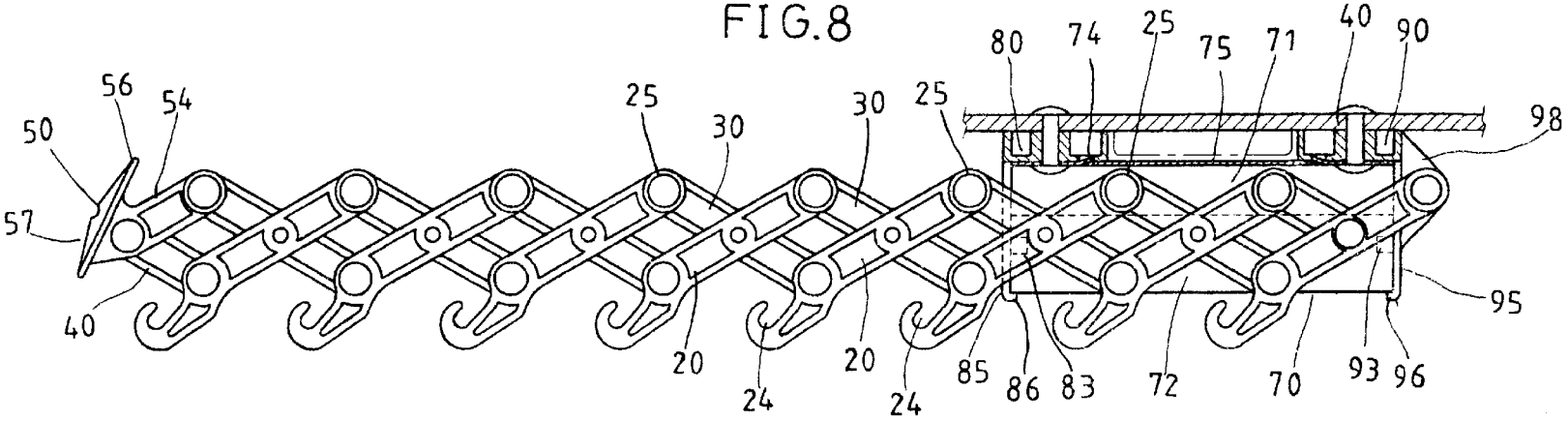
FIG. 9 shows a schematic view of the present invention in the unfolded state.

As shown in FIG. 5, each of the rear inclined fork rods 30 is fastened pivotally between the front inclined fork rod 20 and the fork slide clamp slot 23 such that the center pivoting pillar 31 is engaged with the center pivoting holes 21, and that the top end and the bottom end of each rear inclined fork rod 30 are slidably held in the top end and the bottom end of the fork slide clamp slot 23 of the front inclined fork rod 20. The pivoting bolts 60 are engaged with the end pivoting holes 22 and 32 of the front inclined fork rod 20 and the rear inclined fork rod 30. The rear inclined connection rod 40 is fastened pivotally between the fork slide clamp slots 23 of the front inclined fork rod 20. The end pivoting hole 42 of the rear inclined connection rod 40, the center pivoting hole 21 and the end pivoting hole 22 of each front inclined fork rod 20 are engaged with the pivoting bolt 60. The clamp slot 53 of the front inclined connection rod 54 of the action body 50 is engaged with the top ends of the rear inclined fork rod 30 and the rear inclined connection rod 40 such that the pivoting bolt 60 is engaged with the back pivoting hole 51 and end pivoting hole 52 of the front inclined connection rod 54, the pivoting holes 42 and 32 of the rear inclined connection rod 40 and the rear inclined fork rod 30. The base of the present invention is fastened pivotally with a piece of luggage by means of the end pivoting hole 22 of the front inclined fork rod 20 located at the terminal. The front inclined fork rods 20 can be pushed by the action body 50 such that the front inclined fork rods 20 are joined together in a compact manner, as illustrated in FIG. 8. All hanging hooks 24 are also packed together closely. The base of the present invention can be expanded by pulling the action body 50 to bring about the unfolding of the front inclined fork rods 20, as illustrated in FIG. 9. In the meantime, the hanging hooks 24 are also pulled apart along with the front inclined fork rods 20 by the action body 50.

Figure 6:
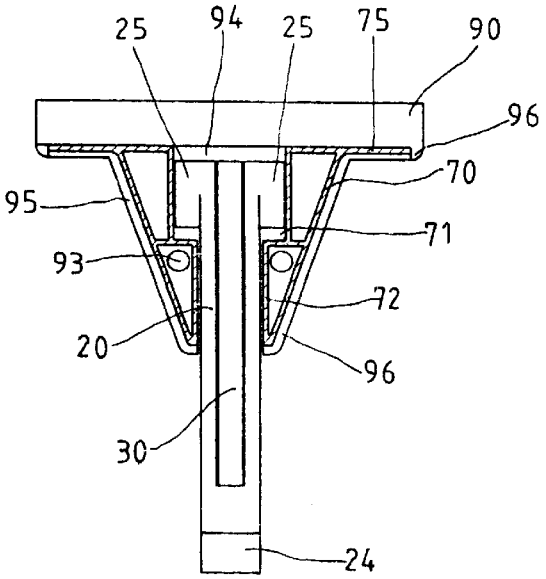
FIG. 6 shows an end sectional view of the present invention in combination.
Figure 7:
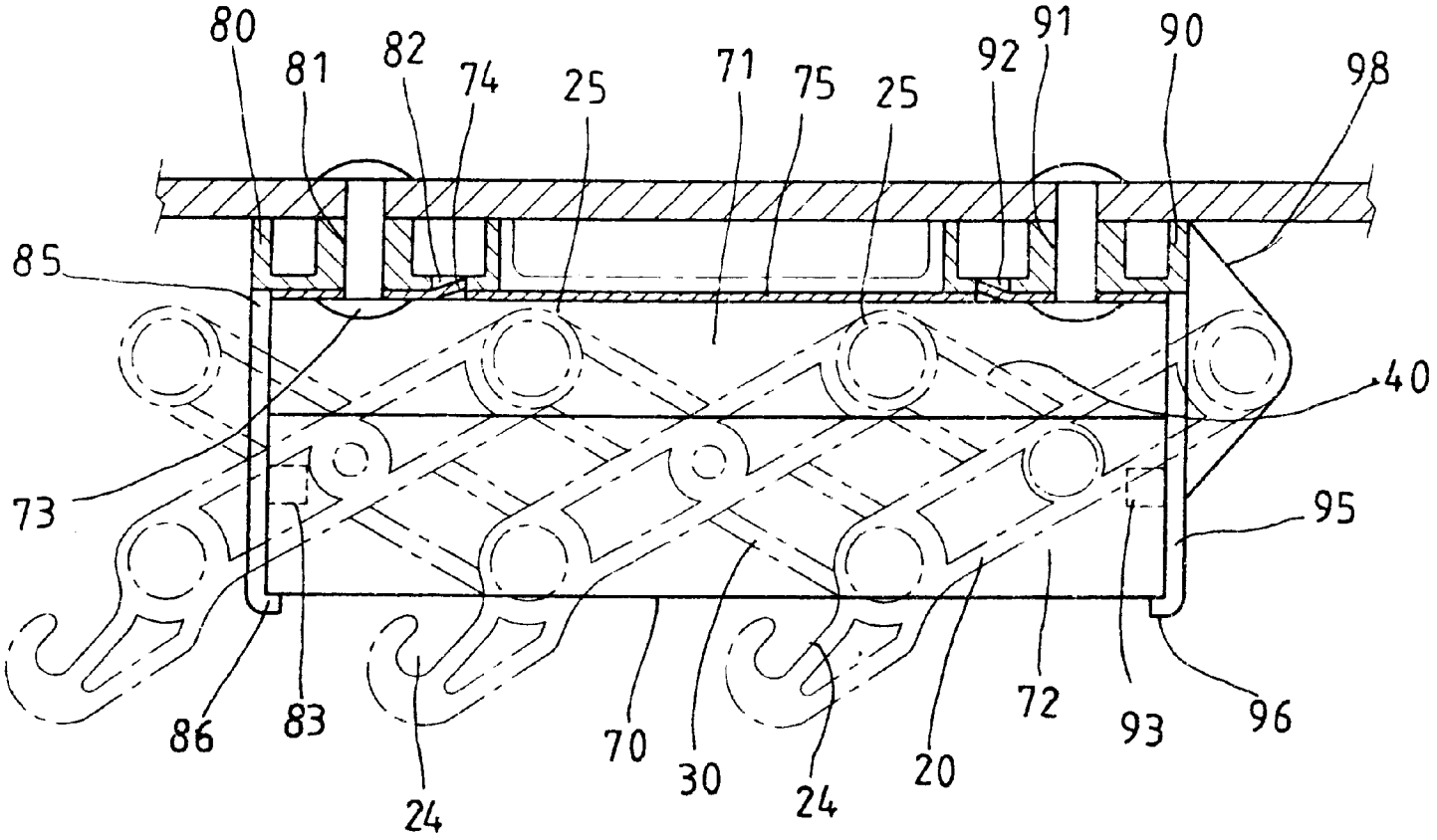
FIG. 7 shows a side sectional view of the present invention in combination.

A slide hanging seat 70 is provided in conjunction with the pivoting slide pillar 25 located at the top end of each front inclined fork rod 20. The slide hanging seat 70 is provided with a hanging slide slot 71 and a clamp guide slot 72. The front inclined fork rod 20 and the rear inclined fork rod 30 are linked such that they are slidably held between the clamp guide slots 72, and that the pivoting slide pillar 25 is slidably held in the hanging slide slot 71, as shown in FIGS. 6 and 7. The slide hanging seat 70 is provided with a top support plate 75 having a through hole 73 and a retaining plate 74. The slide hanging seat 70 is fastened at both a front end thereof and rear a end thereof with the inner side of the top portion of a piece of luggage in conjunction with a face support seat 80 and a back support seat 90. The face support seat 80 and the back support seat 90 are provided respectively with a fastening hole 81 or 90, and a retaining hole 82 or 92, which are corresponding to the through hole 73 and the retaining plate 74 of the top support plate 75. The fastening holes 81 and 91 and the through hole 73 are engaged with a fastening bolt. The face support seat 80 and the back support seat 90 are further provided respectively with a stopping plate 85 or 95, which has a stopping pillar 83 or 93, and a slot 84 or 94, and which is corresponding to the hanging slide slot 71 and the clamp guide slot 72 of the slide hanging seat 70. The face support seat 80 and the back support seat 90 are provided respectively with a stopping frame edge 86 or 96, which extends to reach the periphery of the stopping plate 85 or 95. The stopping plate 95 of the back support seat 90 is provided with two lugs 98 each having a pivoting hole 97 which is engaged with the pivoting bolt 60 which is in turn engaged with the end pivoting hole 22 of the front inclined fork rod 20. The action body 50 is provided at the top edge thereof with an actuating edge 56 which is intended to facilitate the pulling of the front inclined fork rods 20 and the rear inclined fork rods 30. The action body 50 is further provided at the front edge thereof with a pushing face 57 which is intended to facilitate the pushing of the front inclined fork rods 20 and the rear inclined fork rods 30 such that the front inclined fork rods 20 and the rear inclined fork rods 30 are joined together.

Figure 11:
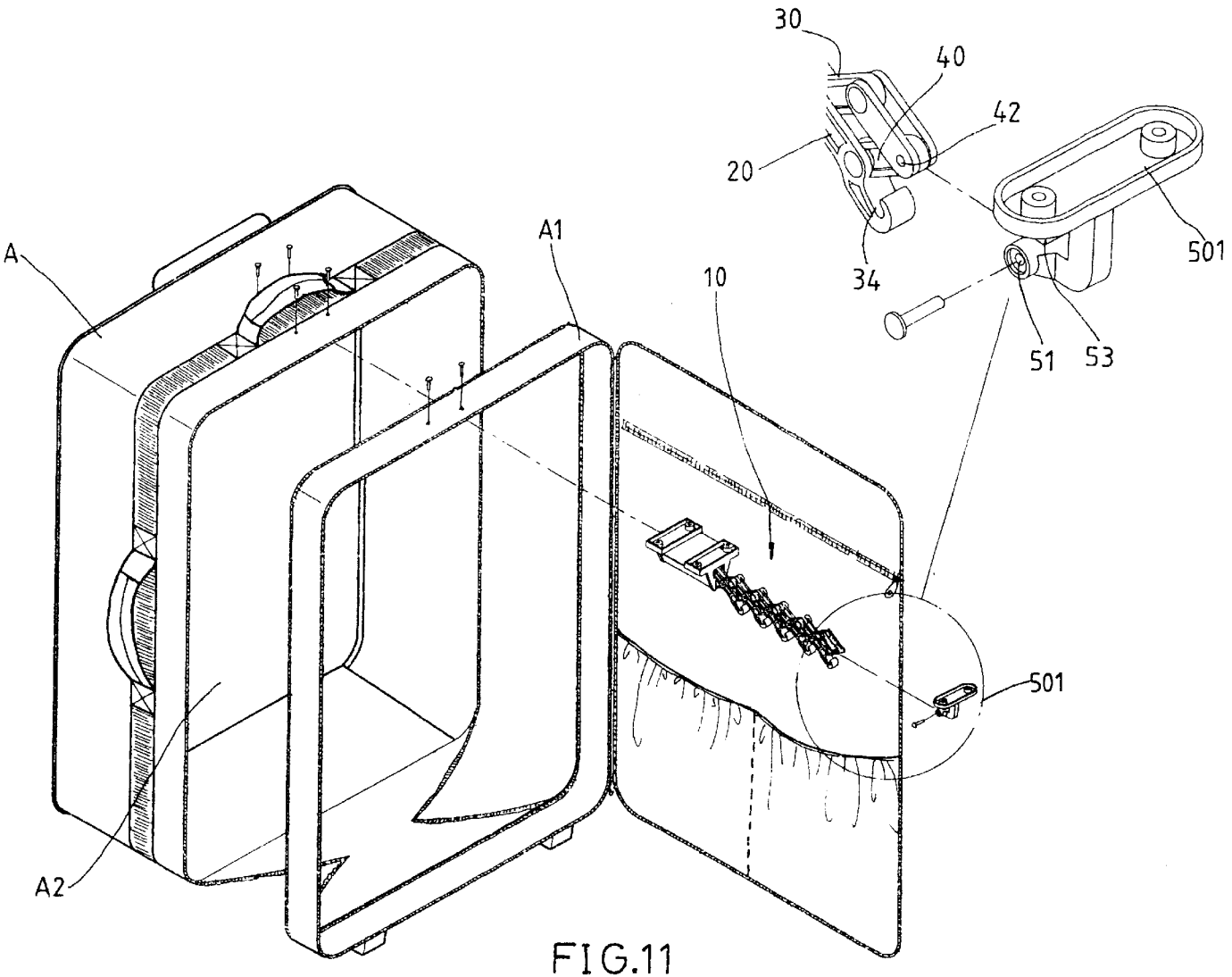
FIG. 11 shows an exploded view of the embodiment of the present invention.
Figure 12:
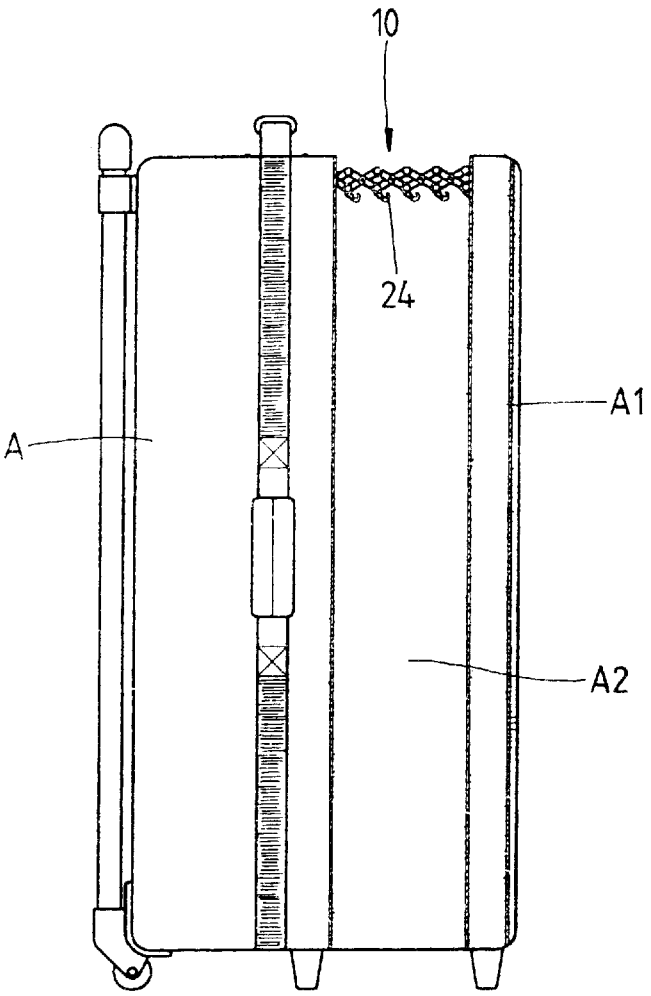
FIG. 12 shows a schematic view of the embodiment in operation according to the present invention.
Figure 13:
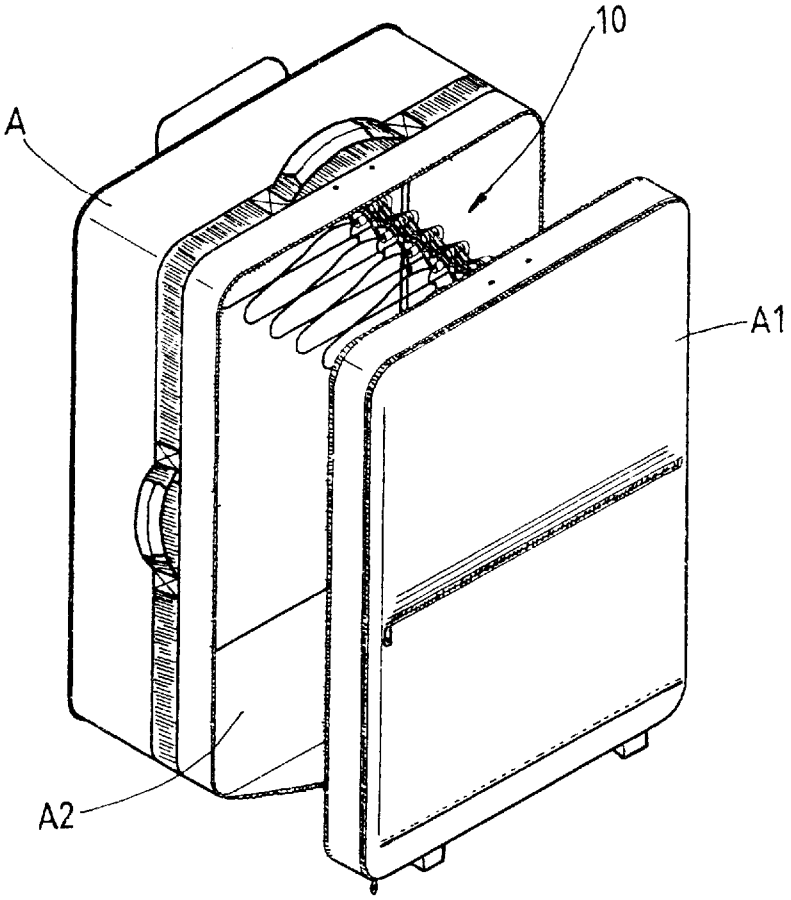
FIG. 13 shows another schematic view of the embodiment according to the present invention.

The action body 50 is further provided with a fastening seat 501 which is in turn provided with a back pivoting hole 51 having a clamp slot 53 for fastening pivotally with the end pivoting hole 42 of the rear inclined connection rod 40. The base 10 of the present invention is fastened with a luggage main body (A) such that the fastening seat 501 is fastened with the top edge of the front support frame edge (A1), as shown in FIG. 11, and that the suit hangers can be removed or put back in through the opening located between the luggage main body (A) and the front support frame edge (A1), as shown in FIGS. 12 and 13.

The front inclined fork rods 20 and the rear inclined fork rods 30 of the present invention are fastened pivotally in an interlocking manner and in conjunction with the front inclined connection rods 54 and the rear inclined connection rod 40. As a result, the base 10 of the present invention is expandable. Each of the front inclined fork rods 20 is provided at one end thereof with the hanging hook 24 which is capable of locating independently at such time when the front inclined fork rods 20 are folded or unfolded. As the hanging hooks 24 are unfolded, the distance between two hanging hooks 24 becomes greater so as to facilitate the independent removal of any one of the suit hangers.

Figure 10:
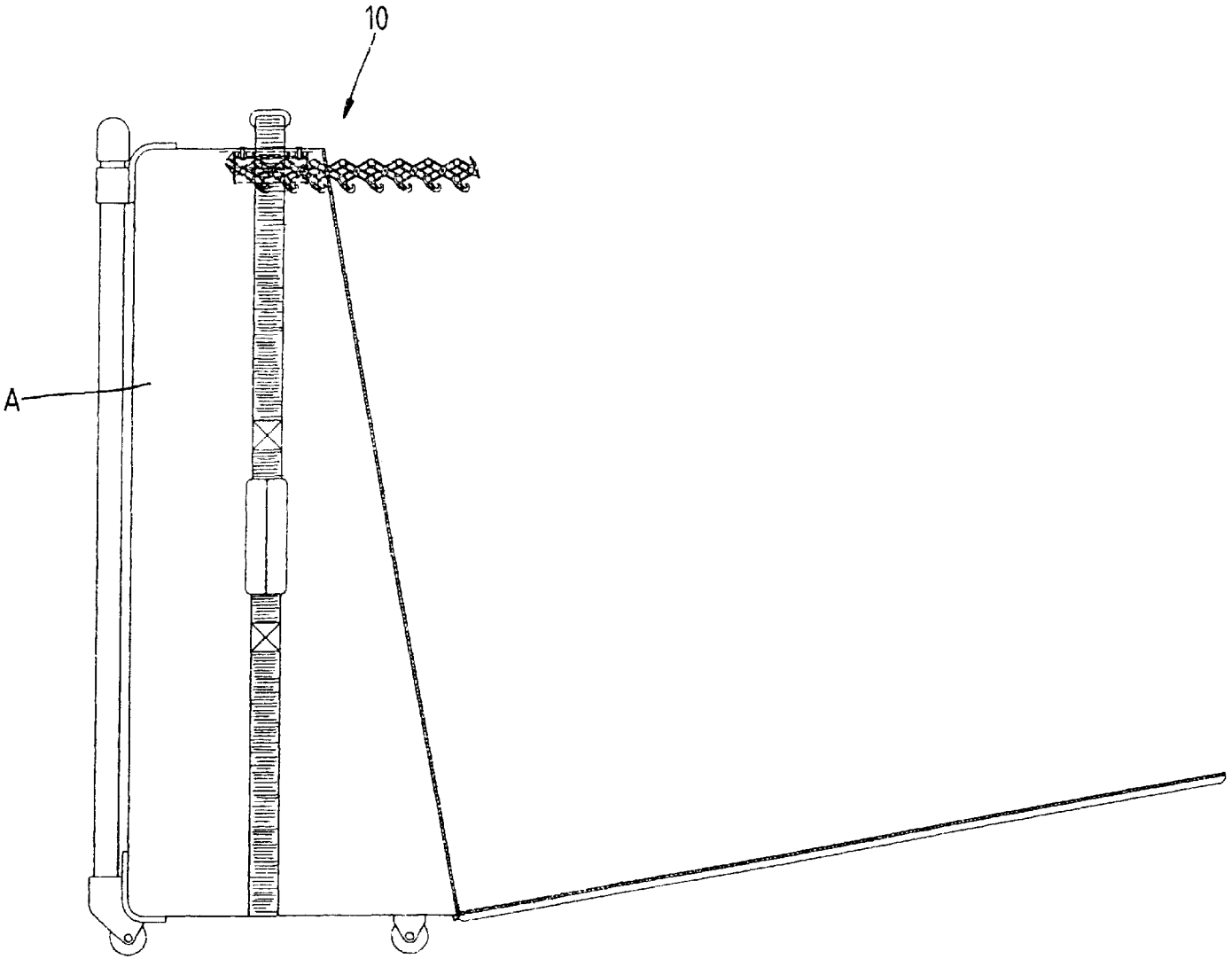
FIG. 10 shows a schematic view of the present invention in operation.

The base 10 of the present invention is fastened at the rear end thereof with the rear section of the top portion of the luggage main body (A) such that the front end of the base 10 of the present invention can be freely unfolded. Accordingly, the bottom portion of the luggage main body (A) can be expanded, as shown in FIG. 10.

The weight of the clothes held the hanging hook 24 of the front inclined fork rod 20 of the present invention is supported by the pivoting slide pillar 25 which is slidably held in the hanging slide slot 71 of the slide hanging seat 70. In the meantime, the front inclined fork rods 20 and the rear inclined fork rods 30 are guided and supported by the clamp guide slot 72 of the slide hanging seat 70 when the front inclined fork rods 20 and the rear inclined fork rods 30 are folded or unfolded. As a result, the base 10 of the present invention can be located stably and used easily, as illustrated in FIGS. 10, 12 and 13.

The embodiment of the present invention described above is to be deemed in all respects as being illustrative and not restrictive. Accordingly, the present invention may be embodied in other specific forms without deviating from the spirit thereof. The present invention is therefore to be limited only by the scopes of the following appended claims.

What is claimed is:

1. An expandable clothes hanger base comprising:

a plurality of front inclined fork rods, which are provided horizontally with a center pivoting hole and two end pivoting holes, and are further provided longitudinally with a slide clamp slot traversing said pivoting holes, and a hanging hook located at one end thereof, said end pivoting holes provided in a periphery thereof with a pivoting slide pillar;

a plurality of rear inclined fork rods each having a thickness corresponding to said slide clamp slot, said rear inclined fork rods provided with a center pivoting pillar corresponding to said center pivoting hole of said front inclined fork rods, and two end pivoting holes corresponding to said two end pivoting holes of said front inclined fork rods;

two rear inclined connection rods each having a thickness capable of cooperating with said slide clamp slot, said rear inclined connection rods provided horizontally in one side thereof with two end pivoting holes separated at an interval which is equal to an interval between said center pivoting hole and said end pivoting holes of said rear inclined fork rods;

an action body provided on a back thereof with a front inclined connection rod having a clamp slot, a back pivoting hole and an end pivoting hole, said back pivoting hole and said end pivoting hole being separated from each other by a distance corresponding to the distance between said center pivoting hole and said end pivoting holes of said front inclined fork rods, said front inclined connection rod provided in a periphery of said end pivoting hole with a pivoting slide pillar; and a plurality of pivoting bolts;

wherein said rear inclined fork rods are fastened pivotally between said center pivoting holes of said slide clamp slots of said front inclined fork rods such that top end and bottom end of each of said rear inclined fork rods are slidably held in top end and bottom end of said slide clamp slot of said front inclined fork rods by said pivoting bolt which is engaged with said end pivoting hole;

wherein said rear inclined connection rods are fastened pivotally and respectively with said slide clamp slots of a front inclined fork rod located at one end and of a front inclined fork rod located at another end by said pivoting bolts which are engaged said end pivoting holes of said rear inclined connection rods and said center pivoting hole and said end pivoting holes of said front inclined fork rods;

wherein said clamp slot of said front inclined connection rod of said action body is engaged with top end of said rear inclined fork rod located at said one end and top end of said rear inclined connection rods, said front inclined connection rods being fastened pivotally with said rear inclined connection rods and said rear inclined fork rods by said pivoting bolts, said front inclined fork rod located at another end being fastened with a luggage body such that said front inclined fork rods can be extracted and retracted by said action body.

2. The expandable clothes hanger hase as defined in claim 1 further comprising a slide hanging seat having a hanging slide slot and a clamp guide slot and capable of cooperating said pivoting slide pillar of said front inclined fork rods such that said front inclined fork rods and said rear inclined fork rods are slidably held in said clamp guide slot, and that said pivoting slide pillar is held in said hanging slide slot, said slide hanging seat provided at a top thereof with a top support plate having a through hole and a retaining plate, said slide hanging seat further provided with a face support seat and a back support seat for fastening said slide hanging seat with a top portion of an inner side of the luggage body by fastening bolts which are engaged with a fastening hole and a through hole of said slide hanging seat and said top support plate, said slide hanging seat further provided with a stopping plate having a stopping pillar and a slot and corresponding in location to said hanging slide slot and said clamp guide slot of said slide hanging seat, said stopping plate provided in a periphery thereof with a stopping frame edge and in a periphery thereof with a stopping frame edge and in a back thereof with two lugs each having a pivoting hole engageable with said pivoting bolt for fastening pivotally said lugs with said front inclined fork rod located at said another end.

3. The expandable clothes hanger base as defined in claim 1, wherein said action body is provided in a top edge thereof with an actuating edge for extracting said front inclined fork rods and said rear inclined fork rods, said action body further provided in a front edge thereof with a pushing face for pushing to retract said front inclined fork rods and said rear inclined fork rods.

4. The expandable clothes hanger base as defined in claim 1, wherein said action body is provided with a fastening seat which is provided in a back thereof with a back pivoting hole having a clamp slot for fastening with the top of the luggage body in conjunction with said end pivoting hole of said rear inclined connection rod such that said fastening seat is fastened with a top edge of said front support frame edge.

* * * * *